US007708174B1

(12) United States Patent
Ho

(10) Patent No.: US 7,708,174 B1
(45) Date of Patent: May 4, 2010

(54) TOP SIZER FOR GARMENT HANGER

(75) Inventor: Leung Ho, Hong Kong (HK)

(73) Assignee: The Build-Up Plastic & Metal Co., Ltd., Kowloon (TW)

( * ) Notice: Subject to any disclaimer, the term of this patent is extended or adjusted under 35 U.S.C. 154(b) by 0 days.

(21) Appl. No.: 11/803,106

(22) Filed: May 11, 2007

Related U.S. Application Data

(60) Provisional application No. 60/799,991, filed on May 12, 2006.

(51) Int. Cl.
*A41D 27/22* (2006.01)

(52) U.S. Cl. ..... 223/85

(58) Field of Classification Search ..... 223/85–98
See application file for complete search history.

(56) References Cited

U.S. PATENT DOCUMENTS

| | | | | |
|---|---|---|---|---|
| 3,024,953 | A | | 3/1962 | O'Keefe |
| 3,949,914 | A | | 4/1976 | Ostroll |
| 4,045,899 | A | | 9/1977 | Richardson |
| 4,322,902 | A | | 4/1982 | Lenthall |
| 4,450,639 | A | | 5/1984 | Duester |
| 4,653,678 | A | * | 3/1987 | Blanchard et al. ..... 223/85 |
| 4,679,340 | A | | 7/1987 | Johansson |
| 4,881,836 | A | | 11/1989 | Blanchard |
| 4,886,195 | A | | 12/1989 | Blanchard |
| 4,997,114 | A | | 3/1991 | Petrou |
| 5,135,141 | A | | 8/1992 | Harmer et al. |
| 5,377,884 | A | | 1/1995 | Zuckerman |
| 5,388,354 | A | | 2/1995 | Marshall et al. |
| 5,503,310 | A | | 4/1996 | Zuckerman et al. |
| 5,573,151 | A | | 11/1996 | Fildan |
| 5,586,697 | A | | 12/1996 | Johansson |
| 5,603,437 | A | | 2/1997 | Zuckerman |
| 5,628,132 | A | | 5/1997 | Marshall et al. |
| 5,641,100 | A | | 6/1997 | Mitchell et al. |
| 5,778,575 | A | | 7/1998 | Deupree et al. |
| 5,785,216 | A | | 7/1998 | Gouldson et al. |
| 5,794,363 | A | | 8/1998 | Marshall et al. |
| 5,857,276 | A | | 1/1999 | Marshall et al. |
| 5,884,422 | A | | 3/1999 | Marshall et al. |
| D410,793 | S | | 6/1999 | Gouldson |
| 5,944,237 | A | | 8/1999 | Gouldson |
| D414,044 | S | | 9/1999 | Choi et al. |
| 6,209,241 | B1 | | 4/2001 | Louw |
| 6,622,897 | B2 | | 9/2003 | Bokmiller et al. |

(Continued)

FOREIGN PATENT DOCUMENTS

| | | |
|---|---|---|
| AU | B1-42320/78 | 6/1979 |

(Continued)

*Primary Examiner*—Shaun R Hurley
*Assistant Examiner*—Andrew W Sutton
(74) *Attorney, Agent, or Firm*—Hoffmann & Baron, LLP

(57) ABSTRACT

A top sizing system for a garment hanger. The system includes a sizer seat secured to an upper portion of the hook of the hanger. The seat includes a ledge and a tab extending substantially perpendicular therefrom. The tab includes at least one guide slot. The system further includes a sizer having an internal cavity configured to receive the tab therein. The sizer has at least one guide repositioned to engage the guide slot whereupon the sizer can be moved from a first unengaged position to a second engaged position.

10 Claims, 3 Drawing Sheets

U.S. PATENT DOCUMENTS

| | | | | |
|---|---|---|---|---|
| 6,726,067 | B2 | 4/2004 | Louw | |
| 7,015,815 | B1 | 3/2006 | Feibelman | |
| 2002/0184799 | A1 | 12/2002 | Chou | |
| 2003/0173381 | A1* | 9/2003 | Louw | 223/85 |
| 2006/0011673 | A1* | 1/2006 | Gouldson | 223/85 |
| 2006/0049222 | A1 | 3/2006 | Pluchino et al. | |
| 2007/0175932 | A1* | 8/2007 | Wu | 223/85 |
| 2007/0228089 | A1* | 10/2007 | Mainetti | 223/85 |
| 2008/0035685 | A1* | 2/2008 | Matkovich et al. | 223/85 |

FOREIGN PATENT DOCUMENTS

| | | | |
|---|---|---|---|
| AU | B1-55 988/80 | | 6/1980 |
| AU | A-49049/85 | | 5/1986 |
| AU | 200048518 | | 7/2001 |
| DE | 3306781 | A1 | 8/1984 |
| DE | 3401816 | A1 | 7/1985 |
| GB | 2386320 | A | 9/2003 |
| JP | Y-S48-23356 | | 7/1973 |
| JP | U-S52-009400 | | 1/1977 |
| JP | U-S52-043890 | | 3/1977 |
| JP | U-S57-095869 | | 6/1982 |
| JP | U-S57-189540 | | 12/1982 |
| JP | U-S61-11374 | | 1/1986 |
| JP | U-S61-147062 | | 9/1986 |
| JP | U-H03-019354 | | 2/1991 |
| JP | U-H05-037183 | | 5/1993 |
| JP | U-H06-052800 | | 7/1994 |
| JP | U-H07-025872 | | 5/1995 |
| JP | A-H07-241229 | | 9/1995 |
| JP | A-H08-140816 | | 6/1996 |
| JP | U-H08-001346 | | 9/1996 |
| JP | A-H10-052356 | | 2/1998 |
| JP | A-2000-287817 | | 10/2000 |
| JP | A-2001-062190 | | 3/2001 |
| JP | A-2001-112605 | | 4/2001 |
| WO | WO 96/23436 | | 8/1996 |

* cited by examiner

TOP SIZER FOR GARMENT HANGER

This application claims the benefit of U.S. Provisional Application No. 60/799,991 filed May 12, 2006.

BACKGROUND OF THE INVENTION

The present invention relates to top sizers and, more particularly, to a top sizing system for a garment hanger.

Garment hangers featuring metal hooks are well known in the art. These hangers typically include a threaded boss located on the upper frame, the threaded boss receiving a threaded end of the metal hook. The body of the hanger is typically made of plastic.

Other known hangers, commonly referred to as plastic hook hangers, are entirely formed of plastic (i.e., both the hook and body of the hanger are formed of plastic).

Those skilled in the art will appreciate that size indicators, i.e., sizers, are typically used with hangers to display relevant information to the purchaser about the item hanging on such hanger. These sizers may be positioned at various locations on the hanger, including at the top of the hook which is commonly referred to as a top sizing system. Although various top sizing systems exist in the prior art, such systems are typically unsuitable for use with a metal hook hanger and/or do not provide a design which can be used on both metal and plastic hook hangers (thereby allowing one universal sizer to be used with either type of hanger). In particular, it has been difficult to secure a top sizing system to a metal hook hangers in an aesthetically-pleasing manner, and in a manner which will resist rotational and transitional movement of the sizing system.

There is therefore a need in the art for a top sizing system which can be used with both metal hook and plastic hook hangers thereby allowing one universal sizer to be used with either type of hanger.

SUMMARY OF THE INVENTION

The present invention, which addresses the needs of the prior art, relates to a top sizing system for a metal hook hanger. The system includes a hook-shaped wire having a threaded end. The system further includes a sizer seat secured to an upper portion of the hook. The seat includes a ledge and a tab extending substantially perpendicular therefrom. The tab includes at least one guide slot. The system further includes a sizer having an internal cavity configured to receive the tab therein. The sizer has at least one guide repositioned to engaged the guide slot where upon the sizer can be moved from a first unengaged position to a second engaged position.

The present invention further relates to a top sizing system for a garment hanger. The system includes a hook for hanging the garment hanger. The system further includes a sizer seat secured to an upper portion of the hook. The seat includes a ledge and a tab extending substantially perpendicular therefrom. The tab includes at least one guide slot. The system further includes a sizer having an internal cavity configured to receive the tab therein. The sizer has at least one guide rib positioned to engage the guide slot whereupon the sizer can be moved from a first unengaged position to a second engaged position.

As a result, the present invention provides a top sizing system suitable for both metal and plastic hook hangers thereby allowing one universal sizer to be used with either type of hanger.

DETAILED DESCRIPTION OF THE INVENTION

Figure 1:
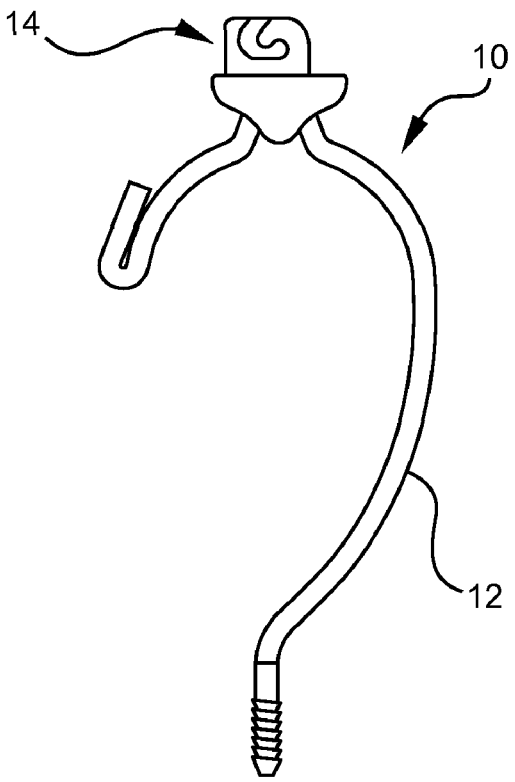
FIG. 1 is a front elevation view of the metal hook of the present invention.
Figure 2:
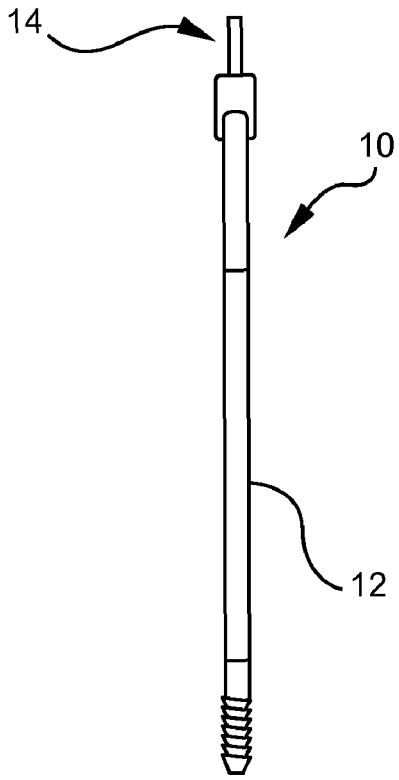
FIG. 2 is a side elevation view of the hook of FIG. 1.
Figure 3:
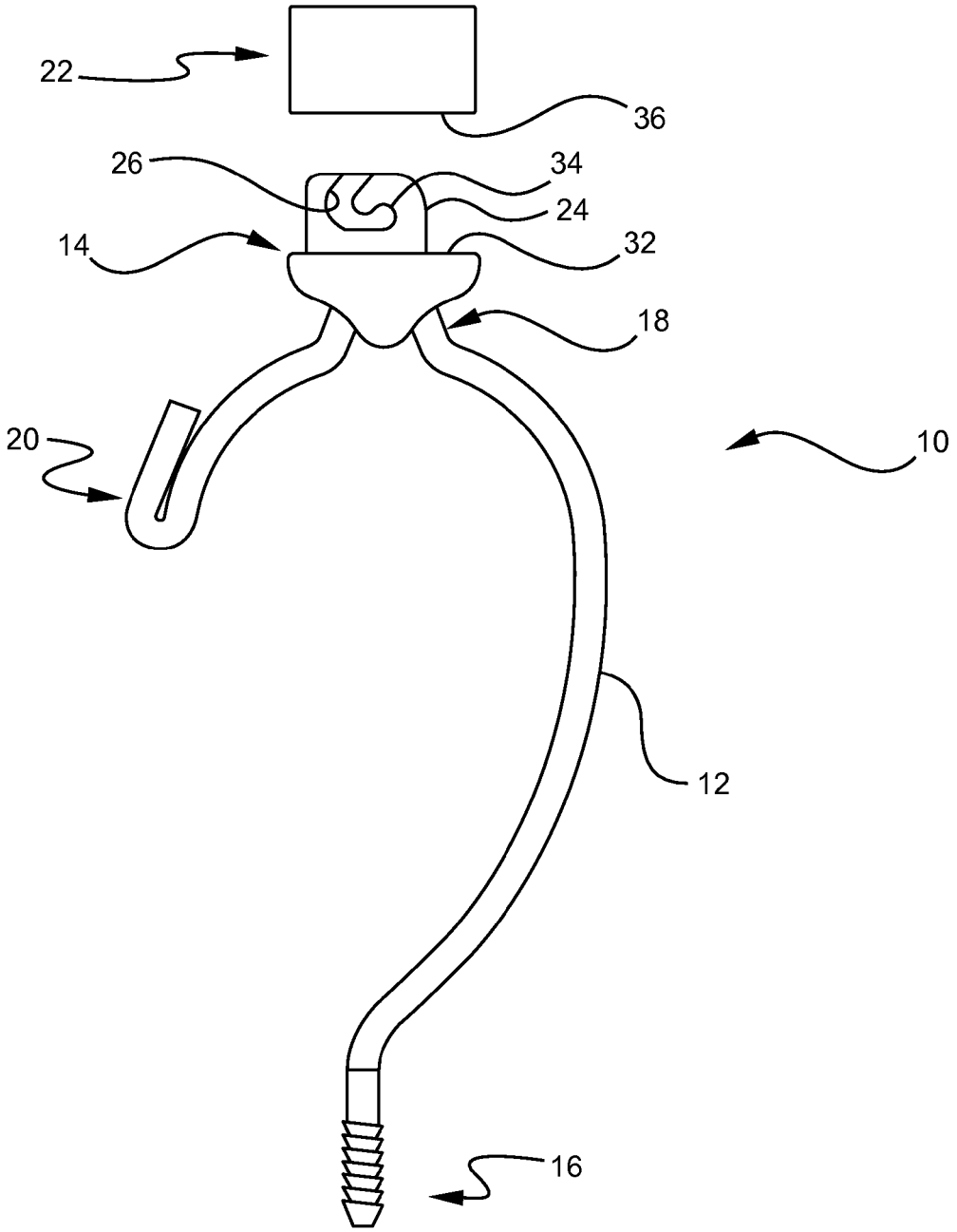
FIG. 3 is a front elevation view of the hook and sizer of the present invention.
Figure 4:
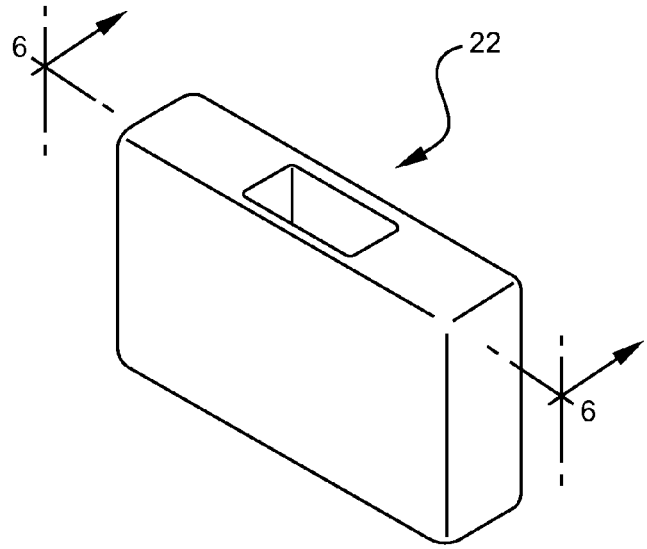
FIG. 4 is a perspective view of the sizer of the present invention.
Figure 5:
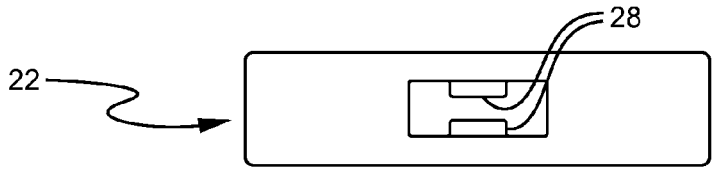
FIG. 5 is a top view of the sizer of FIG. 4.

Referring to FIGS. 1-3, hook 10 includes a wire body 12 and a sizer seat 14. Body 12 is preferably a continuous section of metal wire including a threaded end 16 for insertion into a conventional boss (not shown) of a hanger, a crimp 18 (about which seat 14 is formed) and a pinched end 20 (wherein the end of the wire is folded back against itself in conventional fashion).

In one preferred embodiment, sizer seat 14 is molded about wire body 12 and, more particularly, about crimp 18 formed in wire body 12. In this regard, crimp 18 is configured to provide support for sizer seat 14, e.g., resistance against both rotational and transitional motion. It is contemplated herein that the size and shape of crimp 18 can be varied depending on the size and shape of seat 14. It is further contemplated herein that seat 14 can be independently formed and thereafter secured to body 12, in which event body 12 may or may not include crimp 18.

Figure 6:
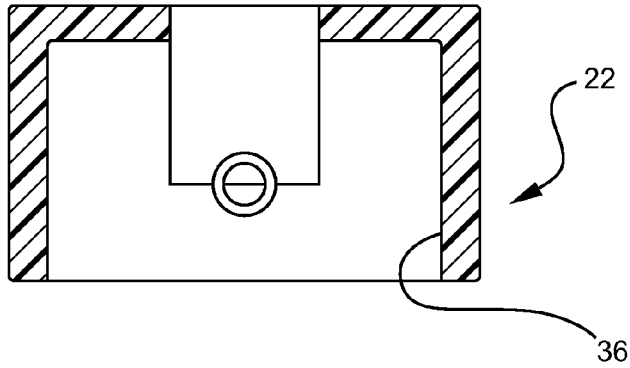
FIG. 6 is a front sectional view of the sizer of FIG. 4.
Figure 7:
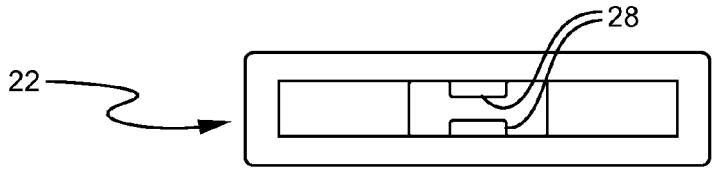
FIG. 7 is a bottom view of the sizer of FIG. 4.

The sizing system of the present invention further includes a sizer 22 designed to cooperate with sizer seat 14. In this regard, sizer seat 14 includes a tab 24 having a pair of opposing slots 26 formed therein (see FIG. 3). As best shown in FIG. 8, sizer 22 includes a pair of opposing guide ribs 28 which engage slots 26 as sizer 22 is placed over tab 24. As best shown in FIG. 6, sizer 22 includes an internal cavity 30 for receipt of tab 24.

In one preferred embodiment, guide slots 26 include a first portion extending substantially perpendicular to ledge 32 of seat 14, and a second portion extending generally parallel to ledge 32 of seat 14. In such a configuration, the sizer is placed over the tab such that ribs 28 engage the first portion of slots 26 whereby the sizer is moved substantially perpendicular to ledge 32. The sizer is then moved substantially parallel to ledge 32 whereby the ribs are moved along the second portion of the slots. In one preferred embodiment, guide ribs 28 removably engage end portions 34 of slots 26 to "snap" the sizer thereon. In another embodiment, guide ribs 28 engage locking elements in end portions 34 to permanently engage sizer 22 to seat 14. In one preferred embodiment, lower edge 36 of sizer 22 contacts ledge 32 at approximately the point where ribs 28 enter the second portion of the slots. The width of the ledge is preferably substantially equal to width of the sizer.

It is contemplated herein that the sizer arrangement of the present invention may also be used on a plastic hook hanger. In such an embodiment, seat 14 would preferably be molded in the same molding operation for forming the hanger, and be integrally formed therewith. The sizer seat formed on this plastic hook hanger would accordingly include a tab 24, as described hereinabove, for cooperation with sizer 22. As such, the same sizer, e.g., sizer 22, could be used with sizer seats formed on metal hook hangers or sizer seats formed on plastic hangers. This of course provides additional flexibility to end user of such product.

It will be appreciated that the present invention has been described herein with reference to certain preferred or exemplary embodiments. The preferred or exemplary embodiments described herein may be modified, changed, added to or deviated from without departing from the intent, spirit and scope of the present invention and it is intended that all such additions, modifications, amendments and/or deviations be included in the scope of the following claims.

What is claimed is:

1. A top sizing system for a metal hook hanger, comprising:

a hook-shaped wire having a threaded end;

a sizer seat secured to an upper portion of said wire, said seat including a ledge and a tab extending substantially perpendicular therefrom, said tab defining opposing surfaces and an upper edge extending therebetween, said tab including at least one guide slot formed on at least one of said opposing surfaces, said guide slot including a first portion extending from said edge in a direction towards said ledge and a second portion extending substantially parallel to said ledge; and a sizer having an internal cavity configured to receive said tab therein, said sizer having at least one guide rib positioned to engage said guide slot whereupon said sizer can be moved from a first unengaged position wherein said guide rib is engaged with said first portion of said guide slot to a second engaged position wherein said guide rib is engaged with said second portion of said guide slot.

2. The system according to claim 1, wherein said wire includes a crimp within said upper portion, and wherein said sizer seat is secured to said wire about said crimp.

3. The system according to claim 2, wherein said sizer seat is molded about said crimp.

4. The system according to claim 1, wherein each surface of said tab includes a guide slot formed thereon, and wherein said sizer includes a pair of opposing guide ribs positioned to engage said guide slots.

5. The system according to claim 4, wherein said guide ribs are positioned within said cavity.

6. The system according to claim 5, wherein each of said guide slots includes a first portion extending from said edge in a direction towards and substantially perpendicular to said ledge and a second portion extending substantially parallel to said ledge.

7. The system according to claim 6, wherein said second portions of said guide slots include locking elements to permanently lock said sizer onto said seat.

8. The system according to claim 7, wherein said tab is substantially positioned on one side of a centerline extending through said sizer seat.

9. The system according to claim 1, wherein said ledge has a width substantially equal to the width of said sizer.

10. A top sizing system for a garment hanger, comprising:

a hook for hanging said garment hanger;

a sizer seat secured to an upper portion of said hook, said seat including a ledge and a tab extending substantially perpendicular therefrom, said tab defining opposing surfaces and an upper edge extending therebetween, said tab including at least one guide slot formed on at least one of said opposing surfaces, said guide slot including a first portion extending from said edge in a direction towards said ledge and a second portion extending substantially parallel to said ledge; and a sizer having an internal cavity configured to receive said tab therein, said sizer having at least one guide rib positioned to engage said guide slot whereupon said sizer can be moved from a first unengaged position wherein said guide rib is engaged with said first portion of said guide slot to a second engaged position wherein said guide rib is engaged with said second portion of said guide slot.

* * * * *